US010718472B2

(12) United States Patent
Bittmann et al.

(10) Patent No.: US 10,718,472 B2
(45) Date of Patent: Jul. 21, 2020

(54) CEMENTING ENDCAP ONTO STRAIGHT GLASS TUBES

(71) Applicant: LEDVANCE GmbH, Garching bei Munchen (DE)

(72) Inventors: Thomas Bittmann, Friedberg (DE); Klaus Eckert, Herbrechtingen (DE); Bernd Pilhoefer, Graben (DE); Florian Wagner, Regensburg (DE)

(73) Assignee: LEDVANCE GMBH, Garching bei Munchen (DE)

( * ) Notice: Subject to any disclaimer, the term of this patent is extended or adjusted under 35 U.S.C. 154(b) by 0 days.

(21) Appl. No.: 16/176,712

(22) Filed: Oct. 31, 2018

(65) Prior Publication Data

US 2019/0137051 A1 May 9, 2019

(30) Foreign Application Priority Data

Nov. 9, 2017 (DE) ..... 10 2017 126 257

(51) Int. Cl.

| | |
|---|---|
| ***F21V 1/00*** | (2006.01) |
| ***F21K 9/272*** | (2016.01) |
| ***F21K 9/66*** | (2016.01) |
| ***F21K 9/278*** | (2016.01) |
| ***F21K 9/90*** | (2016.01) |
| ***F21V 3/02*** | (2006.01) |
| ***F21V 23/00*** | (2015.01) |
| ***F21V 23/06*** | (2006.01) |
| *F21Y 103/10* | (2016.01) |
| *F21Y 115/10* | (2016.01) |

(52) U.S. Cl.

CPC ..... *F21K 9/272* (2016.08); *F21K 9/278* (2016.08); *F21K 9/66* (2016.08); *F21K 9/90* (2013.01); *F21V 3/02* (2013.01); *F21V 23/009* (2013.01); *F21V 23/06* (2013.01); *F21Y 2103/10* (2016.08); *F21Y 2115/10* (2016.08)

(58) Field of Classification Search

CPC . F21K 9/272; F21K 9/275; F21K 9/27; F21K 9/90; F21V 31/00; F21V 31/005; F21Y 2103/00

See application file for complete search history.

(56) References Cited

U.S. PATENT DOCUMENTS 3,993,386 A * 11/1976 Rowe ..... H01R 33/942 439/236
4,949,007 A * 8/1990 Takagi ..... H01J 5/56 313/318.02
4,990,821 A * 2/1991 Blaisdell ..... H01J 61/40 313/112

(Continued)

FOREIGN PATENT DOCUMENTS

DE 202009005160 U1 1/2010
DE 2011051974 U1 3/2012

(Continued)

*Primary Examiner* — Matthew J. Peerce
(74) *Attorney, Agent, or Firm* — Hayes Soloway PC

(57) ABSTRACT

A light fixture includes a light-permeable tube with an end cap pushed onto a free end of the tube, a light module arranged inside the tube and a driver device at least partially received in the tube for driving the light module, wherein the tube has a substantially constant external diameter over its entire longitudinal extent.

20 Claims, 6 Drawing Sheets

(56) References Cited

U.S. PATENT DOCUMENTS

| | | | | |
|---|---|---|---|---|
| 5,904,415 | A * | 5/1999 | Robertson | F21V 19/008 362/217.16 |
| 9,337,598 | B1 * | 5/2016 | Baright | H01R 33/76 |
| 2010/0046222 | A1 | 2/2010 | Yang | |
| 2011/0249440 | A1 | 10/2011 | Socarras | |
| 2013/0301255 | A1 | 11/2013 | Kim et al. | |
| 2015/0176770 | A1 * | 6/2015 | Wilcox | F21K 9/90 362/224 |
| 2015/0308669 | A1 * | 10/2015 | Moreno | F21V 31/005 362/157 |
| 2015/0377423 | A1 | 12/2015 | Lu | |
| 2017/0102131 | A1 * | 4/2017 | Chen | F21V 23/0407 |

FOREIGN PATENT DOCUMENTS

| | | | | |
|---|---|---|---|---|
| DE | 102011053062 | A1 | 11/2012 | |
| DE | 2012100373 | U1 | 5/2013 | |
| DE | 102012203886 | A1 | 9/2013 | |
| DE | 102014214604 | A1 * | 1/2016 | F21V 3/02 |
| DE | 102014214604 | A1 | 1/2016 | |
| DE | 102015224674 | A1 | 6/2017 | |
| EP | 2679891 | A1 | 1/2014 | |
| JP | 2011070988 | A | 4/2011 | |
| JP | 2014063616 | A | 4/2014 | |
| KR | 1020110027215 | A | 3/2011 | |
| WO | 2009035203 | A1 | 3/2009 | |
| WO | 2017007126 | A1 | 1/2017 | |

* cited by examiner

CEMENTING ENDCAP ONTO STRAIGHT GLASS TUBES

CROSS-REFERENCE TO RELATED APPLICATIONS AND PRIORITY

This patent application claims priority from German Patent Application No. 102017126257.1 filed Nov. 9, 2017, which is herein incorporated by reference in its entirety.

TECHNICAL FIELD

The present disclosure relates to a light fixture, for example a LED tube light.

BACKGROUND

Light fixtures are known which have a tube or a tubular housing, the ends are covered by end caps which are fitted thereon, and a light module is arranged inside the tube.

In this case it is known to use end caps which have a base and cylindrical collar extending from the base. The collar usually has the same external diameter as a central region of the tube. In order to enable assembly of the tube and the end cap, the ends of the tube have a region with reduced external diameter, so that the cylindrical part of the end cap can be pushed over this region. Between the end cap and the region with reduced diameter, a foamable cement is provided which foams during heating and thus connects the end cap and the tube end to one another. During foaming, in order to prevent the foaming cement from foaming out from the overlap region between the end cap and the region with a reduced external diameter of the tube, the end cap is fitted to a transition point from which the tube again has its normal, moderate diameter which, together with the end of the end cap, by reciprocal abutment, provides a seal against any escape of foaming cement. In other words, the end cap is pressed by its end onto the glass of the tube. As a result, an escape of foaming cement between the end of the end cap and the tube to the outside can be substantially prevented.

Furthermore, it is known for a driver device for driving the light module to be arranged on the end cap, wherein the driver device is inserted at least partially into the tube during assembly. The dimensions of the driver device are limited because of the region of the tube with a reduced external diameter. In other words, the reduction of the diameter of the tube limits the maximum possible radial overall size of the driver device.

SUMMARY

Starting from the known prior art, it is an object of the present invention to provide an improved light fixture.

This object is achieved by a light fixture with the features of the independent claim 1. Advantageous further embodiments are apparent from the subordinate claims, the description, and the drawings.

Accordingly a light fixture, preferably a LED light fixture, particularly preferably a LED tube light, is proposed, comprising a light-permeable tube with an end cap pushed on a free end of the tube, a light module arranged inside the tube and a driver device at least partially received in the tube for driving the light module. According to the invention the tube has a substantially constant external diameter over its entire longitudinal extent.

The term "light-permeable" is understood here to mean a property for electromagnetic radiation emitted by the light module, in particular light emitted by the light module, in particular light in the visible spectrum, that is at least partially transmissive with or without scattering. In particular the aforementioned term covers transparent and opaque tubes as well as tubes which are provided with a coating which produces a light emission which is homogeneous to the human eye.

Because the tube has a substantially constant external diameter over its entire longitudinal extent, an improved fitting as well as simplified manufacture of the light fixture can be achieved. In particular, the tube no longer has to be provided with the region with a reduced external diameter, so that there is no need for at least one manufacturing step in the manufacture of the tube.

Moreover, as a result, a larger insertion and accommodation space is provided in the tube for the driver, since this is no longer delimited by the region with a reduced external diameter. As a result the driver can have larger components, and therefore can be higher-powered and/or more compact in the longitudinal direction of the tube.

The end cap and/or the tube preferably has a substantially uniform wall thickness. In this case any reductions in the wall thickness due to manufacturing tolerances, for example due to a bend, or increases in the wall thickness due to rounding, in particular at free ends, are included by the term "substantially uniform wall thickness".

According to a further preferred embodiment, the end cap has a first cap region with an external diameter and a second cap region which has an internal diameter. The second cap region adjoins the first cap region and overlaps the tube. The internal diameter of the second cap region is greater than the external diameter of the first cap region and the internal diameter of the second cap region is preferably greater than the external diameter of the tube. In this way it is possible, on the one hand, to provide a tube with a large external diameter and at the same time to provide a region of the end cap with a comparatively small external diameter, which preferably corresponds to a diameter required for insertion of the light fixture into a light fixture socket. The internal diameter of the second cap region is preferably greater than the external diameter of the tube, so that the end cap can be fitted onto a free end of the tube in the region of the second cap region.

According to a further preferred embodiment the internal diameter of the second cap region is configured in such a way that there is an annular gap in the second cap region between the end cap and the tube. In other words, the second cap region surrounds the tube in the circumferential direction radially from the outside based on the longitudinal axis of the tube.

According to a further preferred embodiment the end cap has a radially inwardly directed taper on an open end of the second cap region remote from the first cap region, wherein the taper preferably extends substantially to the external diameter of the tube. In other words, between the narrowest part of the taper and the tube there is only a small spacing, by comparison with the size of the gap, between the taper and the tube, and preferably the gap is greater by a multiple than the spacing. As a result, an escape of bonding material from the gap via the taper and the spacing onto the outer face of the light fixture can be reduced or even completely prevented.

According to a further preferred embodiment, a bonding cement, preferably a foamed bonding cement, for producing a connection and/or sealing between the end cap and the tube is arranged between the second cap region and the tube, wherein the bonding cement preferably seals and/or fills a gap between the second cap region and the tube. As a result, a secure fastening of the end cap to the tube and/or furthermore sealing of the connection region between the end cap and the tube can be achieved.

According to a further preferred embodiment, an accommodating space to receive expanded and/or foamed bonding cement is formed between the first cap region and the second cap region, wherein the accommodating space is preferably formed by a transition region from the first cap region to the second cap region. As a result, for the cement which expands during the expansion, a space is provided in which it can expand. Therefore, a pressure or volume flow produced by the expansion can be reduced in direction and by the taper, so that less or no bonding material escapes there.

According to a further preferred embodiment, the external diameter of the first cap region corresponds to the external diameter of the tube and/or a diameter predetermined by a socket for receiving the light fixture. In this way it can be provided that the light fixture can be received in sockets, in particular standardized sockets, which are designed to receive conventional light fixtures, in particular conventional tube lights and/or fluorescent tubes.

According to a further preferred embodiment, the internal diameter of the second cap region and a wall thickness of the end cap are configured at least in the second diameter region in such a way that a resulting external diameter of the second cap region is smaller than or equal to a predetermined maximum standard diameter for tube lights of a specific type. As a result, it is possible that the light fixture can be inserted into the conventional sockets without the light fixture with the end cap colliding with parts of the socket.

According to a further preferred embodiment, the light module is a LED module or a LED chip. A plurality of light modules, in particular LED modules or LED chips, are preferably received in the tube.

According to a further preferred embodiment, the light fixture is configured as a retrofit tube light for replacement of a conventional fluorescent tube.

BRIEF DESCRIPTION OF THE DRAWINGS

Preferred further embodiments of the invention are explained in greater detail by the following description of the drawings. In the drawings.

DETAILED DESCRIPTION OF THE DRAWINGS

Figure 1:
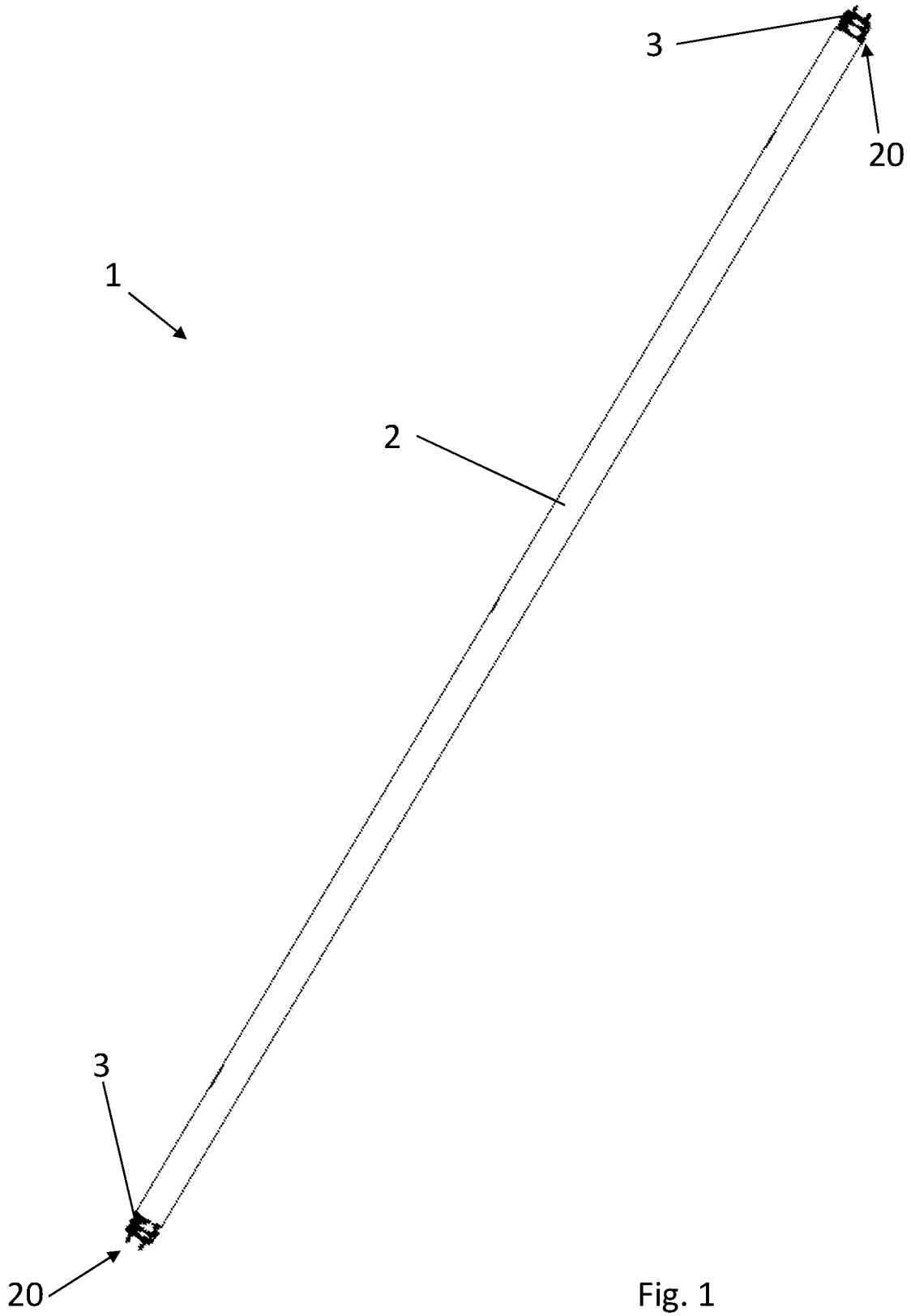
FIG. 1 shows a perspective side view of a light fixture according to the invention.

Preferred exemplary embodiments are described below with reference to the drawings. In this case elements which are the same, similar, or act in the same way are provided with identical reference numerals in the different drawings, and repeated description of some of these elements is omitted in order to avoid redundancies.

FIG. 1 shows a perspective side view of a light fixture 1 according to the invention. The light fixture 1 comprises a light-permeable tube 2 with end caps 3 fitted on each of the two free ends 20 of the tube 2.

The light fixture 1 is designed as a retrofit tube light for replacement of a conventional fluorescent tube.

Figure 2:
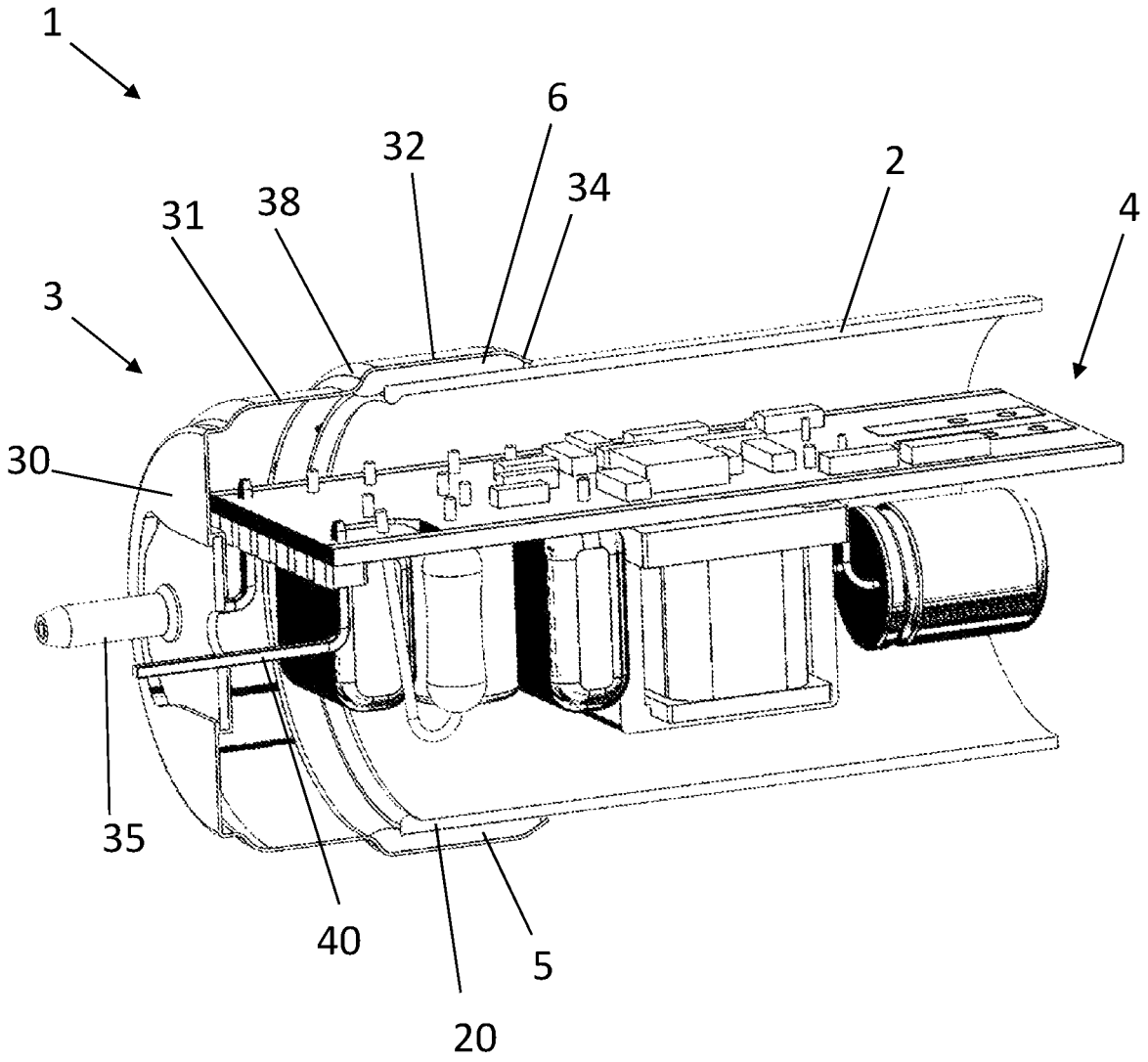
FIG. 2 shows schematically a perspective sectional view of one end of the light fixture according to FIG. 1.

FIG. 2 shows schematically a perspective sectional view of one end of the light fixture 1 according to FIG. 1. A plurality of light modules (not shown here) provided in the form of LEDs are arranged inside the tube 2. The light modules can be provided for example in the form of LED chips.

Furthermore, a driver device 4 for driving the plurality of light modules is received at least partially in the tube 2.

The driver device 4 is electrically conductively connected by means of connecting wires 40 to contact pins 35, which are arranged externally on the end cap 3 and extend from an end face 30 of the end cap 3 in the longitudinal direction of the light fixture 1, for contacting contact means of a socket for receiving the light fixture 1.

A first cap region 31 extends from the end face 30 of the end cap 3 and is adjoined in the direction of the center of the light fixture by a second cap region 32, wherein the first cap region 31 and the second cap region 32 are connected by means of a transition region 38. The second cap region 32 partially overlaps the tube 2, so that between the second cap region 32 and the tube 2 a gap 6 is formed, in which a foamed bonding material in the form of a foamed bonding cement 5 is provided which connects the end cap 3 to the tube 2 and further seals and/or fills the gap 6.

On the end remote from the first cap region 31 the second cap region 32 has a radially inwardly directed taper 34 which correspondingly tapers the gap 6 and accordingly ensures that the bonding cement 5 does not escape or does not significantly escape from the gap 6 to the outer face of the tube 2.

As can be seen immediately from FIG. 1 in conjunction with FIG. 2, the tube 2 has a substantially uniform external diameter over its entire longitudinal extent, and therefore a substantially cylindrical shape.

A "substantially" constant external diameter is understood to mean that the external diameter only varies due to production tolerances. On the other hand, an actively formed alteration of the external diameter is not provided.

Figure 3:
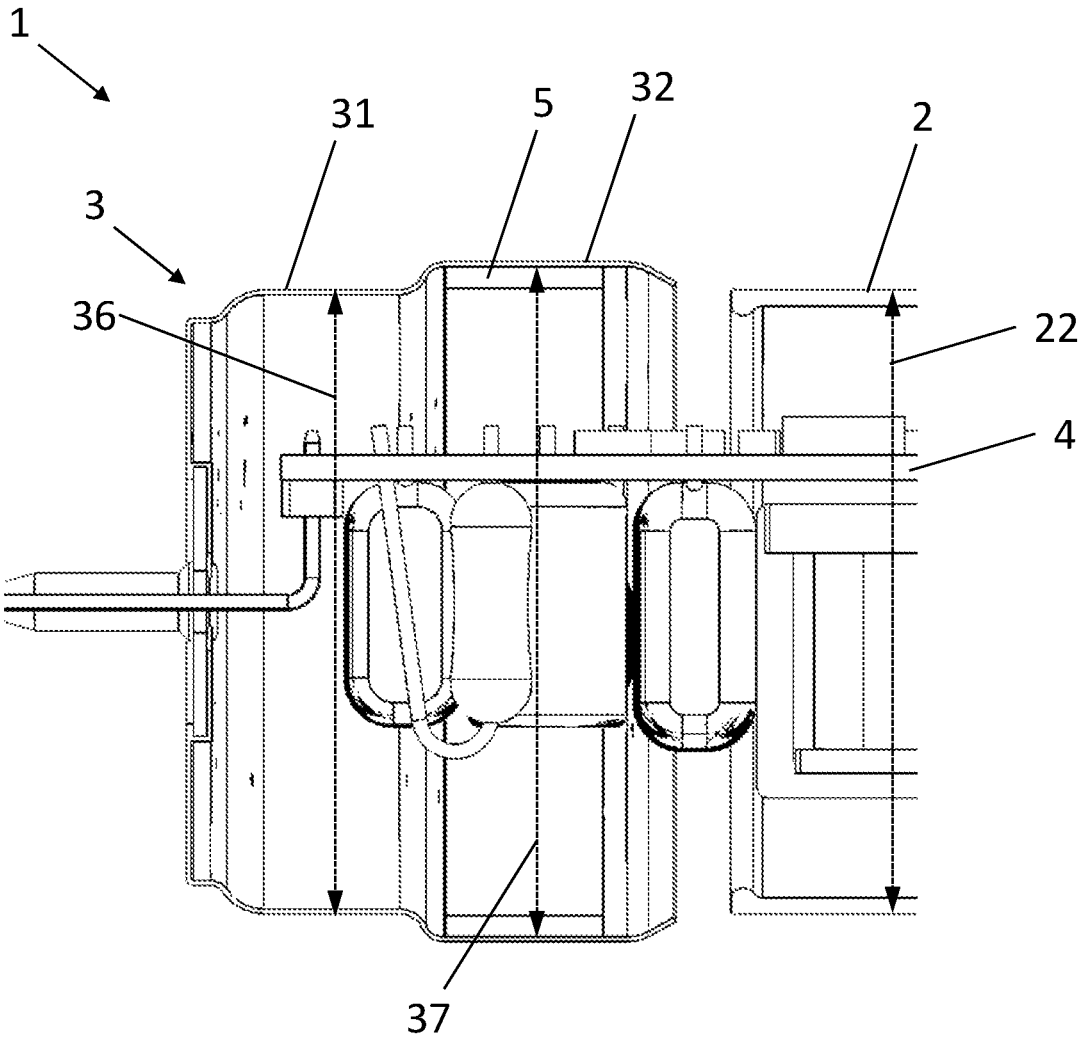
FIG. 3 shows schematically a sectional view of the end of the light fixture according to FIGS. 1 and 2 before assembly.

FIG. 3 shows schematically a sectional view of the end of the light fixture 1 according to FIGS. 1 and 2 before assembly. The constant external diameter of the tube 2 is indicated by means of the reference 22.

Furthermore, an external diameter of the first cap region 31 is indicated by means of the reference 36, and an internal diameter of the second cap region 32 is indicated by means of the reference 37.

The external diameter 36 of the first cap region 31 is selected in such a way that it corresponds to a diameter predetermined by a socket for receiving the light fixture 1.

Thus, the external diameter 36 of the first cap region 31 can also correspond to the external diameter of the tube 2.

The internal diameter 37 of the second cap region 32 is selected in such a way that a gap 6 which forms between the tube 2 and the second cap region 32 corresponds to a predetermined size which, for example, encompasses a predetermined volume.

For mounting of the end cap 3 and the tube 2, first a foamable bonding cement 5 is applied to the inner face of the second cap region 32. Then the driver 4 is fastened to the end cap 3 in a manner which is known per se. Then the end cap 3 with its second cap region 32 overlaps the tube 2, wherein in this case the driver 4 is pushed at least partially into the tube 2.

Figure 4:
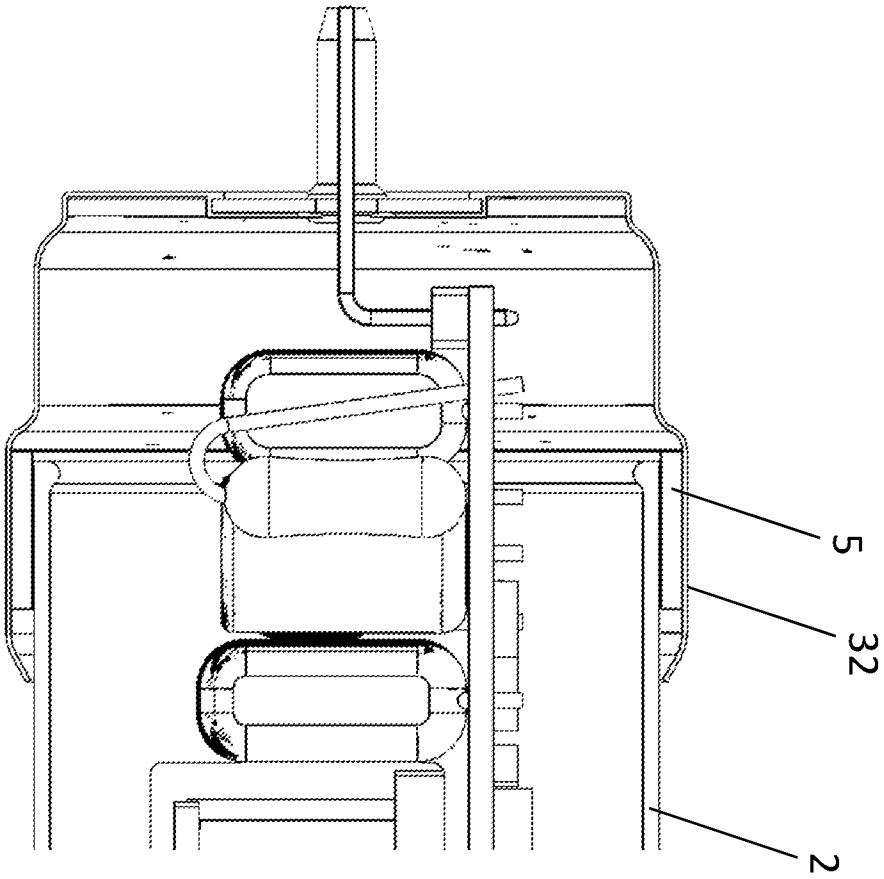
FIG. 4 shows schematically a sectional view of the end of the light fixture according to FIGS. 1 and 2 after fitting of the end cap.

FIG. 4 shows schematically a sectional view of the end of the light fixture 1 according to FIGS. 1 and 2 after fitting of the end cap 3. The foamable bonding cement 5 is now arranged between the second cap region 32 and the tube 2.

Then the bonding cement 5 is made to foam by application of heat, so that it expands and thus also fills and preferably seals the gap 6 which is formed between the tube 2 and the second cap region 32.

Figure 5:
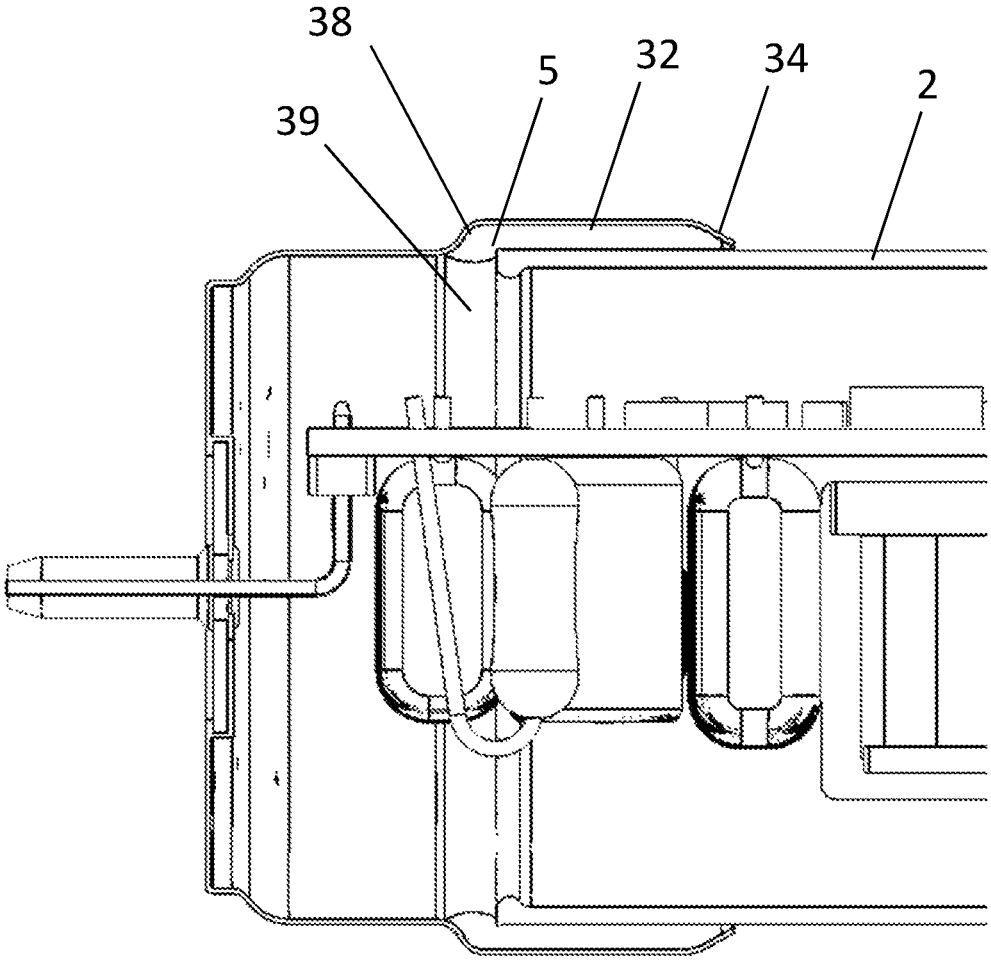
FIG. 5 shows schematically a sectional view of the end of the light fixture according to FIGS. 1 and 2 after foaming of a bonding cement.

FIG. 5 shows schematically a sectional view of the end of the light fixture 1 according to FIGS. 1 and 2 after the foaming of the bonding cement 5.

The foamed bonding cement 5 is expanded up to the position in which the taper 34 almost or actually touches the tube 2, and on the other side in the direction of the interior of the light fixture.

In this case a receiving space 39 for receiving expanding and/or foaming bonding material is formed by a transition region 38 between the first cap region 31 and the second cap region 32. Consequently, during the expansion the foaming bonding cement 5 can expand freely into the receiving space 39, without narrow points causing a back pressure or counter-pressure against the expansion, which could also possibly press the bonding cement 5 out of the gap 6 onto the outer face of the tube 2.

Figure 6:
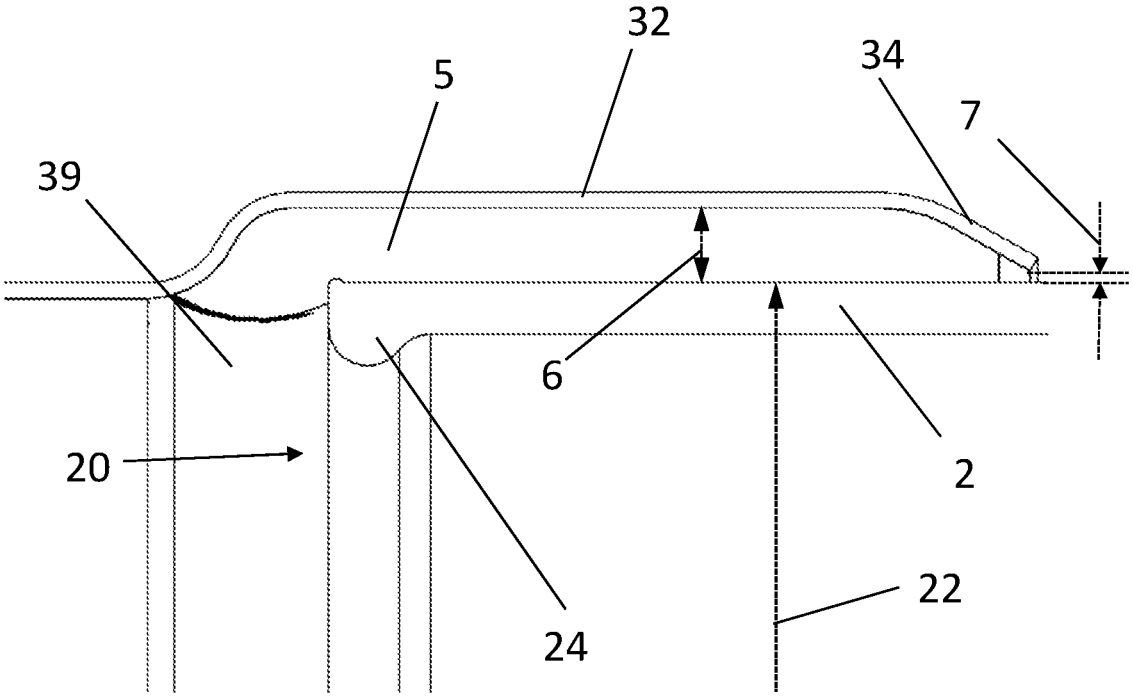
FIG. 6 shows schematically a sectional view of a detail of the view according to FIG. 5.

FIG. 6 shows schematically a sectional view of a detail of the view according to FIG. 5. It clearly shows the gap 6 formed between the tube 2 and the second cap region 32 in which the bonding cement 5 extends.

The inwardly directed taper 34 extends approximately to the external diameter 22 of the tube 2. In other words, between the narrowest part of the taper 34, i.e. at the free end thereof, and the tube 2 there is a smaller spacing 7 by comparison with the size of the gap 6. In this case the radial extent of the gap 6 is greater than the spacing 7, preferably by multiples of the spacing 7. As a result, an escape of bonding cement 5 from the gap 6 via the taper 34 and the spacing 7 onto the outer face of the light fixture 1 can be reduced or even completely prevented.

Because of the taper 34, a back pressure deters the bonding cement 5 from expanding further during the foaming through the spacing opening formed by the spacing 7. The back pressure is produced in the foaming bonding cement 5 at the taper 34 in the direction of the spacing or of the small spacing opening resulting therefrom.

As can again be seen from FIG. 6, the tube has a substantially constant external diameter 22 over its entire longitudinal extent. In this case likewise the wall thickness of the tube is substantially constant.

Only at the free end 20 of the tube 2 there is a marginally enlarged wall thickness due to the separating rounding 24 produced during the manufacture of the tube 2.

Although the invention has been illustrated and described in greater detail by the depicted exemplary embodiments, the invention is not restricted thereto and other variations can be deduced therefrom by the person skilled in the art without departing from the scope of protection of the invention.

In general "a" or "an" may be understood as a single number or a plurality, in particular in the context of "at least one" or "one or more" etc., provided that this is not explicitly precluded, for example by the expression "precisely one" etc.

Also, when a number is given this may encompass precisely the stated number and also a conventional tolerance range, provided that this is not explicitly ruled out.

If applicable, all individual features which are set out in the exemplary embodiments can be combined with one another and/or exchanged for one another, without departing from the scope of the invention.

LIST OF REFERENCES

1 light fixture
2 tube
20 end
22 external diameter
24 separating rounding
3 end cap
30 end face
31 first cap region
32 cap region
34 taper
35 contact pin
36 external diameter
37 internal diameter
38 transition region
39 receiving space
4 driver
40 connecting wire
5 bonding cement
6 gap
7 spacing

The invention claimed is:

1. A light fixture comprising:

a tube having light-permeable properties and a substantially constant external diameter over its entire longitudinal extent;

an end cap, overlapping a free end of the tube, the end cap comprising:

a first cap region; and a second cap region adjoining the first cap region, wherein an internal diameter of the second cap region is greater than the external diameter of the tube such that an annular gap is provided between the second cap region and the tube, wherein the second cap region adjoins the first cap region such that the annular gap transitions to a receiving space formed longitudinally between the first cap region and the second cap region;

a light module arranged inside the tube; and a driver device at least partially received in the tube and electrically connected to the light module thereby driving the light module.

2. The light fixture according to claim 1, wherein the internal diameter of the second cap region is greater than an external diameter of the first cap region.

3. The light fixture according to claim 1, wherein the end cap has a taper at an open end of the second cap region located opposite the first cap region, wherein the taper extends radially inwardly toward the tube.

4. The light fixture according to claim 3, wherein a radial extent of the annular gap is greater than a spacing of the taper from the tube.

5. The light fixture according to claim 1, further comprising a bonding cement disposed within the gap between the second cap region and the tube.

6. The light fixture according to claim 1, wherein the external diameter of the first cap region is equivalent to the external diameter of the tube or to a diameter of a socket for receiving the light fixture.

7. The light fixture according to claim 1, wherein the light module is a light-emitting diode (LED) module or a LED chip.

8. The light fixture according to claim 1, wherein the light fixture is configured as a retrofit tube light for replacement of a conventional fluorescent tube.

9. The light fixture according to claim 3, wherein the taper extends substantially to the external diameter of the tube.

10. The light fixture according to claim 5, wherein the bonding cement at least one of seals and fills the gap between the second cap region and the tube.

11. The light fixture according to claim 1, wherein the receiving space is formed by a transition region from the first cap region to the second cap region.

12. The light fixture according to claim 1, wherein the first cap region and the second cap region together are of single-piece construction.

13. The light fixture according to claim 1, wherein the receiving space is formed immediately longitudinally between the first cap region and the second cap region.

14. The light fixture according to claim 1, wherein the first cap region and the second cap region are joined by an intervening transition region that extends radially outward beyond an external diameter of the first cap region.

15. The light fixture according to claim 14, wherein the transition region at least partially overlaps a volume of the receiving space.

16. The light fixture according to claim 14, wherein the first cap region, the transition region, and the second cap region together provide a continuous sidewall of the end cap.

17. The light fixture according to claim 1, wherein the second cap region includes:

a first end which connects with the first cap region via an intervening transition region; and a second end which is tapered radially inward toward the tube.

18. The light fixture according to claim 17, wherein the second end is tapered so as to exert a back pressure that deters a bonding cement from escaping the gap at the second end of the second cap region.

19. The light fixture according to claim 1, wherein the annular gap transitions directly to the receiving space such that the annular gap and the receiving space connect to provide a continuous volume.

20. The light fixture according to claim 1, wherein the receiving space is formed longitudinally between the first cap region and the second cap region beyond the free end of the tube.

* * * * *